United States Patent [19]

Ogden

[11] Patent Number: 4,822,458

[45] Date of Patent: Apr. 18, 1989

[54] ANODIC COATING WITH ENHANCED THERMAL CONDUCTIVITY

[75] Inventor: Thomas R. Ogden, San Diego, Calif.

[73] Assignee: The United States of America as represented by the Secretary of the Navy, Washington, D.C.

[21] Appl. No.: 188,774

[22] Filed: Apr. 25, 1988

[51] Int. Cl.[4] ..... C25D 11/10

[52] U.S. Cl. ..... 204/58; 204/273; 204/274

[58] Field of Search ..... 204/58, 273, 274

[56] References Cited

U.S. PATENT DOCUMENTS 1,027,495 5/1912 McNitt ..... 204/274

1,964,736 7/1934 Laurin et al. ..... 204/274

3,997,412 12/1976 Megaya et al. ..... 204/58

4,214,952 7/1980 Sato et al. ..... 204/58

*Primary Examiner*—T. Tung

*Attorney, Agent, or Firm*—Harvey Fendelman; Thomas Glenn Keough

[57] ABSTRACT

A method of and apparatus for anodization uses an electrolyte consisting of 1.0 percent by weight of aqueous solution of oxalic acid, an anodization temperature in the range of 0°-5° C., and an anodization voltage starting at 100 volts and progressing to 300 volts after 90 minutes at an anodization current density of 2-3 amps per decimeter$^2$ to provide a 30-40 micrometer thickness having a thermal conductivity of 1.3 Watt/meter/C.

2 Claims, 2 Drawing Sheets

ANODIC COATING WITH ENHANCED THERMAL CONDUCTIVITY

STATEMENT OF GOVERNMNET INTEREST

The invention described herein may be manufactured and used by or for the Government of the United States of America for governmental purposes without the payment of any royalties thereon or therefor.

BACKGROUND OF THE INVENTION

Thick anodic coatings, commonly referred to as "hard anodize", are used to protect aluminum equipment against abrasion and corrosion. Definitive measurements of the thermal conductivity of this type of coating were not available in the open literature, even though hard anodic coatings have been in use for many years. Since anodic coatings on aluminum consist mainly of aluminum oxide and the thermal conductivity of bulk, crystalline aluminum oxide is very high, as high as that of some metals, the thermal conductivity of anodic coatings is widely believed in the industry to be quite high. In tests of very high-efficiency heat-transfer equipment, such as that used in underwater vehicle propulsion systems, it has become apparent that the thermal conductivity of the available commercial coatings is low enough to be a significant factor in the design of these systems. The thermal conductivity of typical commercial coatings was measured and found to be approximately 0.7 Watts/meter/C. On the other hand, the thermal conductivity of bulk, crystalline aluminum oxide is about 33 Watt/meter/C, or about a factor of 50 greater than that of hard, anodic coatings. This apparent discrepancy can be explained by the fact that anodic coatings, as they are commercially applied, are quasiamorphous materials (not crystalline) and that they contain large amounts of materials other than aluminum oxide. As a general rule, the thermal conductivity of amorphous materials is an order of magnitude or more smaller than that of the same material in crystalline form, so that the low thermal conductivity of anodic coatings is not very surprising despite the widely held belief to the contrary.

An anodic coating with enhanced thermal conductivity is needed for high performance systems which also require very good abrasion and corrosion resistance. Such systems would be those which require very efficient heat transfer due to limitations of size of the heat transfer area or the temperature difference over which the system is constrained to operate, and are exposed to large amounts of handling or service in a corrosive environment. Another use would be in certain electronic circuits, where aluminum is used as a heat sink, and when good dielectric strength as well as good thermal conductivity are necessary. Some applications concerning electronics require a thick, anodic coating for electrical insulation, but also require good thermal conductivity for dissipation of heat.

Typically, the anodization of aluminum and its alloys is an electrochemical process for producing a tough, electrically insulating coating on aluminum parts. The part to be anodized is immersed in an electrolyte, and a positive potential is applied to the aluminum part in reference to a cathode of lead or other material. As current flows between the aluminum anode and the cathode, aluminum on the surface of the anode is converted to aluminum oxide and a coating is formed. The coating also contains significant amounts of hydrated aluminum oxide in addition to anhydrous aluminum oxide, and anion from the electrolyte, e.g. the coatings contain about 14 percent sulfate for sulfuric acid-based electrolytes. The chemical composition and morphological properties of the coating depend greatly on the anodization parameters, such as voltage, current density, temperature, type and concentration of the electrolyte.

When a weak electrolyte is used, which will not dissolve the coatings, a thin non-porous coating is produced. The coating grows to a certain thickness and, since it is a very good electrical insulator, blocks further current flow, stopping the anodization process. These barrier type coatings are typically less than 1 micrometer in thickness, are easily abraded from the surface, and are used, for example, as dielectrics in electrolytic condensers. The electrolytes which produce this type of anodic coating are generally aqueous solutions of a very weak acid such as boric acid.

When the anodic coating has considerable solubility in the electrolyte, then a thin, barrier layer is formed on the aluminum surface and a porous outer layer is formed on the side exposed to the electrolyte. The pores initiated at sites on the coating continuously progress into the barrier layer allowing more aluminum to be converted. If the electrolyte is not so aggressive that the rate of dissolution of the coating is as great as the rate of coating formation then thick coatings (as much as 200 micrometers in thickness) can be applied to the aluminum part. These thick, porous coating are called "hard anodic" coatings due to their very high abrasion resistance, and have been used for the protection of aluminum surfaces from abrasion and corrosion for about forty years. A relatively strong acid such as sulfuric acid is used in aqueous solution to produce this type of coating.

The anodization parameters are interdependent, so that a change in one parameter frequently results in a change in one or more other parameters. For example, at constant anodization current the voltage necessary to produce a coating is determined to a large degree by the solubility of the coating in the electrolyte. The coating solubility is determined by the strength of the acid used, the concentration of the solution, and the solution temperature. Because the anodic coating is a very good electrical insulator, the anodization voltage is impressed across the coating during anodization and not across the volume of the electrolyte. The anodization voltage effects such coating properties as the porosity, chemical composition, and the morphology or degree of crystallinity in the coating.

Electrolytes which operate at low voltages are favored in commercial processes in order to reduce electrical power costs. Sulfuric acid electrolytes, used in most commercial hard coating processes, operate typically at voltages from 15 to 130 Volts. As the coating is formed on the aluminum part, a progressively higher voltage is required at constant current. Anodization above 130 volts is not feasible in sulfuric acid, because runaway anodization, referred to as "burning", takes place and causes severe damage to the part. Anodic coatings are the preferred means of protection of aluminum articles against abrasion and corrosion and enormous quantities of aluminum are anodized annually in the United States. For very inexpensive articles produced in mass quantities, electrical power costs of anodizing can be an important factor in their manufacture.

However, for expensive pieces of equipment, which must have long service lifetimes in severe environments, the electrical power cost will be outweighed and a coating with improved thermal conductivity is desirable for high-efficiency, heat-transfer applications.

A family of organic acids can be used in anodization electrolytes to produce thick coatings at voltages higher than 130 volts. This class of aqueous electrolytes based on the organic carboxylic acids was described by J. M. Kape in the *Transactions of the Institute of Metal Finishing,* Volume 45, 1967, pages 34–42. These acids are, in general, considerably weaker than sulfuric acid. Kape showed that thick anodic coatings can be produced at room temperature with electrolytes based on these acids or mixtures of these acids, which have comparable abrasion resistance to the hard anodic coatings produced in sulfuric acid solutions at much lower temperatures. Oxalic acid is the most commonly used member of this group of acids in anodization electrolytes. It and other organic carboxylic acids have been used commercially as additives in sulfuric acid-based electrolytes to raise the temperature at which hard anodizing can be performed in order to reduce refrigeration costs. They are not often used alone without a more aggressive acid, however, because anodization in aqueous solutions of these acids may require high voltages and thus higher electrical power cost.

Thus, a continuing needs exists in the state-of-the-art for an anodic coating with enhanced thermal conductivity for high performance systems which also require very good abrasion and corrosion resistance.

SUMMARY OF THE INVENTION

The present invention is directed to providing a method and apparatus for anodizing aluminum parts such as used on compact high performance undersea vehicles. The anodized coating has an enhanced thermal conductivity to assure reliable performance. An aluminum article and a lead mass are immersed in a chilled bath of an aqueous solution of oxalic acid. The bath is agitated by a magnetic stirrer and kept at the proper temperature by a refrigeration system to assure an efficient and uniform cooling of the aluminum article. A 1% concentration of oxalic acid at 0–5° C. and an increase of anodization voltage to approximately from 100–300 volts, creates a relatively constant current of between 2 and 3 amps per decimeter$^2$ so that a coating is created having a thermal conductivity increased to 1.3 Watts/meter/C. This is a thermal conductivity increase of about a factor of two over the thermal conductivity of commercial hard anodic coatings that have about 0.7 Watt/meter/C. The thermal conductivity of the coatings is significantly greater for anodic coatings applied in electrolytes with 1.5 weight percent concentration or less oxalic acid.

A coating having an improved thermal conductivity of about 1.3 Watt/meter/C calls for immersing an aluminum part in an electrolyte having a 1.0 percent by weight aqueous solution of oxalic acid, cooling the electrolyte bath to a temperature in the range of 0–5° C., agitating the cooled electrolyte bath to wash about the aluminum part to be anodized, coupling an anodizing voltage of between 100–300 volts and maintaining the anodizing voltage for a period of about 90 minutes to provide an anodization current density of 2–3 amps per decimeter$^2$, thereby providing a thickness of coating of between 30–40 micrometers.

A prime object is to provide for a new anodic coating process for aluminum parts such as those found on high performance undersea vehicles.

Another object of the invention is to provide an anodic coating process and coated articles having thermal conductivities twice that of typical commercial hard coatings.

Another object is to provide an anodic coating process and anodic coated parts having an abrasion resistance comparable to or greater than standard hard coatings yet with a thermal conductivity equal to twice that of typical commercial hard coatings.

Still a further object is to provide for an anodic coating having a corrosion resistance greater than that of conventional coatings, due to the very high anodization voltage used in the process.

Still another object is to provide an anodic coating process having a barrier layer thickness substantially proportional to the final anodization voltage as compared to conventional coatings.

Still yet a further object is to provide for an anodic coating process and coated parts which reduce the cost of waste water treatment for the spent electrolyte.

These and other objects of the invention will become more readily apparent from the ensuing specification and claims when taken in conjunction with the appended drawings.

DESCRIPTION OF THE PREFERRED EMBODIMENT

Figure 1:
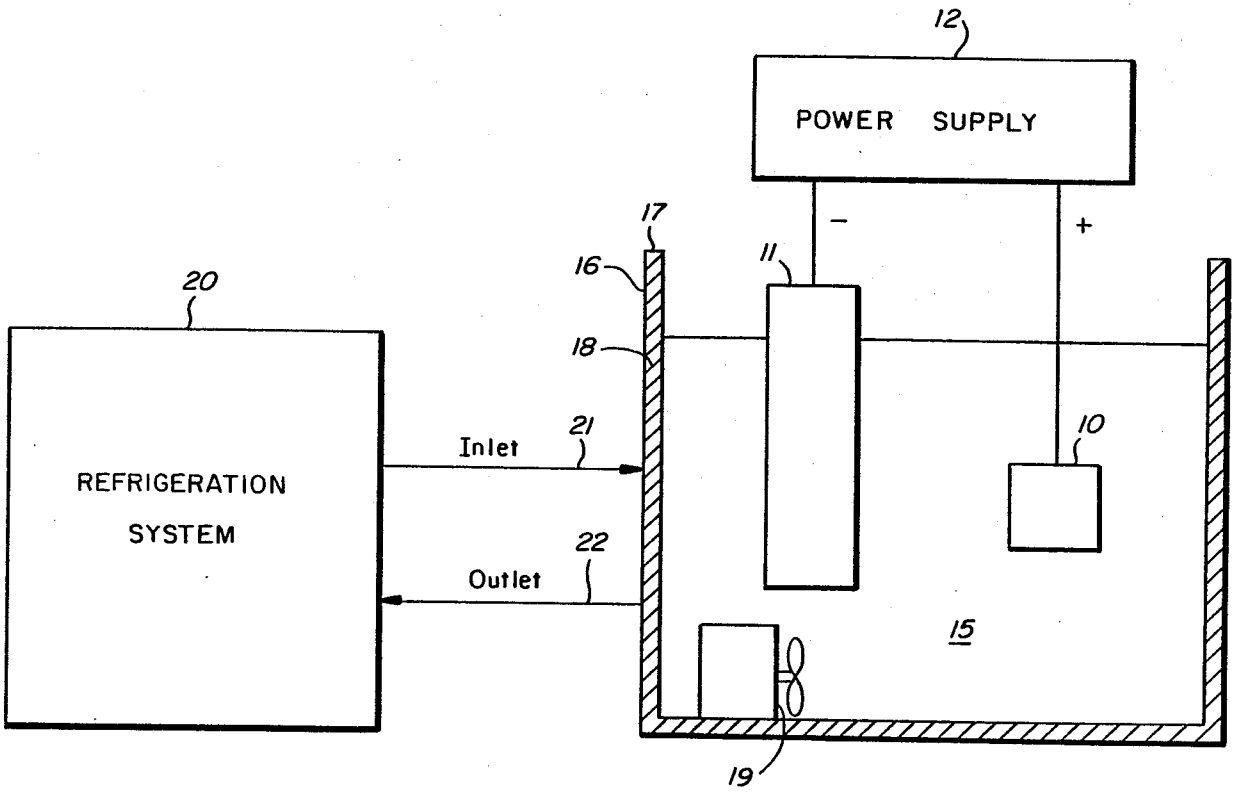
FIG. 1 is a schematic depiction of an apparatus for performing the anodization of aluminum parts.

Referring now to FIG. 1 of the drawings an aluminum article to be anodized 10 and a lead cathode 11 are suitably coupled to an appropriate power supply 12 that has the capability for increasing voltage while maintaining current substantially constant. Both the electrodes are immersed in a suitable electrolyte 15 which is in this case is an aqueous solution of oxalic acid.

The aqueous solution is contained in a vessel 16 having a hollow walled structure that includes a chamber 17 for receiving and recirculating a suitable coolant 18. Optionally, the hollow wall structure could assume the form of a cooling coil (not shown) immersed in the electrolyte.

A refrigeration system 20 is provided with a suitably interconnected feeder line 21 that passes coolant to the chamber and receives cooling fluid for recirculation from the chamber via an outlet duct 22. The circulation of the coolant maintains a temperature of the aqueous solution as a chilled bath at a required temperature for reasons to be discussed herein below. The chilled bath is agitated via a suitable mixer or pump 19 submerged in the chilled bath so that the aqueous solution, or electrolyte, and aluminum part remain at the proper temperature.

The aluminum part 10 to be anodized is attached to the positive electrode of power supply 12 by means of a wire lead of 99.5% pure titanium. This metal has been found to be more electrochemically passive than aluminum and is attached to the aluminum part by arc welding. The lead cathode 11 is attached to power supply 12 by means of a copper wire or any other suitable conductor.

Both the lead cathode and the aluminum part (anode) are immersed in the electrolyte contained in the anodization vessel. When positive current flows from the anode to the cathode, anodic conversion takes place at the anode surface. Power supply 12 is used in the constant current mode to maintain a steady state current between the anode and cathode. As a consequence, the voltage is increased from an initial value to a final value to maintain a set current.

One anodization vessel was fabricated from glass and had the ethylene glycol cooling solution circulated in a space between its outer walls. A commercially available laboratory recirculating refrigerator pumped the coolant through the space between the walls at a rate of about 8 liters per minute. Although a propeller like structure is shown in the drawings, any suitable stirrer could be selected to maintain uniform cooling of the aluminum part being anodized. Typically, the electrolyte consists of an aqueous solution of oxalic acid and is cooled to just above 0° C. by the laboratory recirculating refrigerator.

The procedure for anodizing aluminum parts calls for the electrolyte being cooled to just above 0° C. with the lead cathode and aluminum part being immersed in the electrolyte in the anodization vessel. First however, the aluminum parts, for example squares of 6061–T6 aluminum alloy, were degreased in acetone, etched for 3–5 minutes in an aqueous sodium hydroxide solution (50 gr/L), desmutted in aqueous nitric acid solution (300 ml/L), and rinsed in deionized water.

Figure 2:
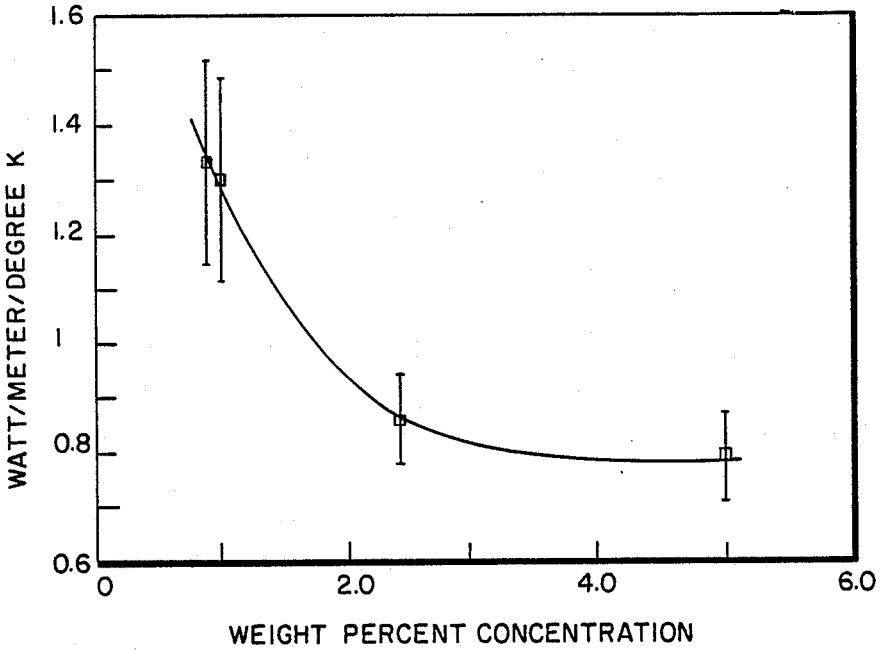
FIG. 2 is a graph of thermal conductivity of the coating versus concentration of oxalic acid in the electrolyte.

The aluminum parts were anodized under a variety of conditions and the thermal conductivity of the aluminum parts were measured by means of the techniques described in the article by T. R. Ogden et al. in Material Letters, Volume 5, pages 84–87. FIG. 2 is a graph of thermal conductivity of the coating versus concentration of oxalic acid in the electrolyte baths. It should be noted that other parameters will change with the electrolyte concentration. In particular, the anodization voltage increases as the oxalic concentration is lowered. The thermal conductivity of 0.8 Watt/meter/C at a concentration of 5 percent by weight oxalic acid corresponds to a anodization voltage range of approximately 60–100 volts. At this high concentration of oxalic acid, the anodization voltage range is about the same as that of conventional anodization processes and the thermal conductivity is approximately the same as the average thermal conductivity of conventional coatings produced in sulfuric acid.

However, at a concentration of 1% by weight oxalic acid, the anodization voltage range is increased to approximately 100-300 volts and the thermal conductivity of the coating increased from 0.8 Watt/meter/C to 1.3 Watt/meter/C. The thermal conductivity represents approximately a factor of two improvement over the thermal conductivity of commercial hard anodic coatings (about 0.7 Watt/meter/C). In other words, the thermal conductivity of the coatings is significantly greater for anodic coatings applied in electrolytes with 1.5 weight percent concentration or less oxalic acid.

The preferred anodization conditions to obtain an improved thermal conductivity of 1.3 Watts/meter/C are the following: an electrolyte consisting of 1.0 percent by weight aqueous solution of oxalic acid; anodization temperature in the range of 0–5 C.; anodization voltage starting at above 100 Volts and progressing to 300 Volts after 90 minutes at an anodization current density of 2–3 amps per decimeter$^2$. The thickness of the coating obtained under these conditions is 30–40 micrometers.

The improved thermal conductivity appears to be a consequence of the high anodization voltages used (100–300 Volts). The high voltages cause ejection of the electrolyte anion from the anodic coating during the anodization process, resulting in a lower percentage of anion impurities in the coating, and may also inhibit hydration of the aluminum oxide contained in the coating. This reduces the amount of impurities in the coating and allows formation of a coating with somewhat more crystalline morphology, resulting in improved thermal conductivity. With an electrolyte consisting of an aqueous solution of oxalic acid at 0–5° C., the optimum concentration of oxalic acid is about 1.0 percent by weight to obtain a process which operates at the desired high voltages. Other acids or mixtures of acids of the carboxylic group can be used in the same manner, however, the concentration of the acid and the temperature electrolyte will be adjusted to obtain a solution which operates at high voltage.

The new anodic coating process produces a coating with a thermal conductivity twice that of the typical commercial hard coating. The abrasion resistance of the coating is comparable to or greater than that of the standard hard coating. Such characteristics make it ideally suitable for a high technology application such as that encountered in high performance undersea vehicles.

The corrosion resistance of this coating is greater than that of the conventional coatings, due to the very high anodization voltage used in the process. The barrier layer thickness is proportional to the final anodization voltage and since the final voltage of this process is several times the voltage used in the conventional processes, a more substantial barrier layer is provided. Since this barrier layer prevents corrosive agents in the environment from reaching the aluminum surface, the corrosion resistance of this coating is superior to that of the conventional coatings. Such an improved resistance to corrosion is ideally suitable to high technology applications in high technology undersea vehicles.

The reduced cost of waste water treatment of the spent electrolyte is a further advantage of using this process. Waste disposal is an expensive problem for commercial anodizers. Due to the much lower aggressiveness of the oxalic acid solution, disposal is much easier than with conventional electrolytes based on sulfuric acid. Oxalic acid, and the carboxylic acids, in general, are much less toxic than sulfuric acid.

Other organic carboxylic acids or mixtures of carboxylic acids (such as malonic, maleic, etc.) can be used in aqueous solution in place of the aqueous solution of oxalic acid. The concentration and electrolyte temperature should be adjusted to obtain anodization voltages in the range of 100-300 volts or higher. Anodization was stopped at 300 volts due to the onset of electrical arcing above 300 volts at where the titanium wire was attached to the aluminum part being anodized. Substitution of another material in place of the titanium wire could make higher anodization voltages possible with an expected improvement in the previously described results.

The voltage/current waveform used for anodization may be DC, or DC with an AC component superimposed. The current can be held constant and the voltage allowed to increase gradually in order to maintain constant current, or the voltage can be held constant and periodically increased in a stepwise manner to maintain continuation of the anodization process.

Obviously, many modifications and variations of the present invention are possible in the light of the above teachings. It is therefore to be understood that within the scope of the appended claims the invention may be practiced otherwise than as specifically described.

I claim:

1. A method of anodizing to provide corrosion and abrasion resistance for an aluminum part that has improved thermal conductivity of about 1.3 Watt/meter/° C. comprising:

coupling the aluminum part to a positive terminal and a lead mass to a negative terminal of a power supply;

immersing the aluminum part and lead mass into an aqueous solution of carboxylic acid;

cooling the aqueous solution to a temperature of between 0° to 5° C.;

varying the potential of the power supply from 100 volts to 300 volts and continuing the varying of the potential for a period of about 90 minutes to provide a corrosion and abrasion resistant coating of about 30 to 40 micrometers.

2. A method according to claim 1 in which the aqueous solution is 1.0 percent by weight of oxalic acid.

* * * * *